US010017939B2

(12) United States Patent
Andresen

(10) Patent No.: US 10,017,939 B2
(45) Date of Patent: Jul. 10, 2018

(54) FIRE-RESISTANCE-RATED THERMALLY INSULATING AND SEALING SYSTEM FOR USE WITH CURTAIN WALL STRUCTURES

(71) Applicant: Hilti Aktiengesellschaft, Schaan (LI)

(72) Inventor: Arndt Andresen, Irving, TX (US)

(73) Assignee: Hilti Aktiengesellschaft, Schaan (LI)

( * ) Notice: Subject to any disclaimer, the term of this patent is extended or adjusted under 35 U.S.C. 154(b) by 69 days.

(21) Appl. No.: 14/950,886

(22) Filed: Nov. 24, 2015

(65) Prior Publication Data

US 2017/0145685 A1 May 25, 2017

(51) Int. Cl.
*E04B 1/94* (2006.01)
*E04B 2/96* (2006.01)

(52) U.S. Cl.
CPC ..... *E04B 1/947* (2013.01); *E04B 2/96* (2013.01)

(58) Field of Classification Search
None
See application file for complete search history.

(56) References Cited

U.S. PATENT DOCUMENTS 3,786,604 A * 1/1974 Kramer ..... E04B 1/6801 52/232
4,449,341 A * 5/1984 Taglianetti ..... E04B 2/88 52/235
5,502,937 A * 4/1996 Wilson ..... B32B 15/14 52/273
5,765,332 A * 6/1998 Landin ..... E04B 1/948 52/235
7,424,793 B1 * 9/2008 Shriver ..... E04B 2/88 52/235
7,644,549 B2 * 1/2010 Speck ..... E04B 2/90 52/235
8,782,977 B2 * 7/2014 Burgess ..... E04B 2/00 52/235
9,016,013 B2 * 4/2015 Stahl, Jr. ..... E04B 2/88 52/235
2009/0126297 A1 * 5/2009 Stahl, Jr. ..... E04B 2/88 52/235
2010/0107532 A1 * 5/2010 Shriver ..... E04B 2/96 52/317
2012/0180414 A1 * 7/2012 Burgess ..... E04B 2/90 52/300
2013/0097948 A1 * 4/2013 Burgess ..... E04B 2/00 52/232
2014/0331579 A1 * 11/2014 Evensen ..... E04B 2/90 52/204.593
2016/0356034 A1 * 12/2016 Andresen ..... E04B 1/68

* cited by examiner

*Primary Examiner* — Brian E Glessner
*Assistant Examiner* — Adam G Barlow
(74) *Attorney, Agent, or Firm* — Crowell & Moring LLP

(57) ABSTRACT

A construction for effectively thermally insulating and sealing of a safing slot between a floor of a building and an exterior wall construction is disclosed. The exterior wall construction includes a curtain wall configuration defined by an interior wall glass surface including one or more aluminum framing members, where the vision glass extends to the finished floor level below. The thermally insulating and sealing system includes an offset leg framing element for receiving the insulating elements and positioned in the zero spandrel area of a glass curtain wall construction including only vision glass to maintain thermally insulating and sealing of the safing slot during exposure to fire and heat in order to maintain a complete seal extending across the safing slot.

25 Claims, 9 Drawing Sheets

FIRE-RESISTANCE-RATED THERMALLY INSULATING AND SEALING SYSTEM FOR USE WITH CURTAIN WALL STRUCTURES

BACKGROUND AND SUMMARY OF THE INVENTION

The present invention relates to the field of constructions, assemblies and systems designed to thermally insulate and seal a sating slot area defined between a curtain wall and the individual floors of a building. In particular, the present invention relates to a fire-resistance-rated thermally insulating and sealing system for use with curtain wall structures which include glass, especially vision glass extending to the finished floor level below.

Curtain walls are generally used and applied in modern building constructions and are the outer covering of the constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

A curtain wall generally transfers horizontal wind loads that are incident upon it to the main building structure through connections at floors or columns of the building. Curtain walls are designed to resist air and water infiltration, sway induced by wind and seismic forces acting on the building and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

However, architects and the public at large appreciate the aesthetics of glass and other light-transmitting materials used in the built environment. Light-transmitting materials, that serve both an aesthetic function as well as a structural function, are appreciated for their economy and visual effects. A common means prescribed by architects to achieve these goals in building structures is through the use of glass curtain wall systems.

A typical glass curtain wall structure is designed with extruded aluminum members. The aluminum frame is typically infilled with glass, which provides an architecturally pleasing building, as well as benefits such as daylighting. Usually, for commercial construction, ¼ inch glass is used only in spandrel areas, while 1 inch insulating glass is used for the rest of the building. In residential construction, thicknesses commonly used are ⅛ inch glass in spandrel areas and ⅝ inch glass as insulating glass. Larger thicknesses are typically employed for buildings or areas with higher thermal, relative humidity, or sound transmission requirements, such as laboratory areas or recording studios.

With a curtain wall, any glass may be used which can be transparent, translucent, or opaque, or in varying degrees thereof. Transparent glass usually refers to vision glass in a curtain wall. Spandrel or vision glass may also contain translucent glass, which could be for security or aesthetic purposes. Opaque glass is used in areas to hide a column or spandrel beam or shear wall behind the curtain wall. Another method of hiding spandrel areas is through shadow box construction, i.e. providing a dark enclosed space behind the transparent or translucent glass. Shadow box construction creates a perception of depth behind the glass that is sometimes desired. Aesthetic design and performance levels of curtain walls can be extremely varied. Frame system widths, depths, anchoring methods, and accessories have grown diverse due to industry and design innovation.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This safing slot is essential to slow the passage of fire and combustion gases between floors. Therefore, it is of great importance to improve firestopping at the safing slot in order to keep heat, smoke and flames from spreading from one floor to an adjacent floor. It is important to note that the firestop at the perimeter slab edge is considered a continuation of the fire-resistance rating of the floor slab. The curtain wall itself, however, is not ordinarily required to have a rating. Conversely, a glass curtain wall, including extruded aluminum members, is rated as 0 hours and the standard fire test method NFPA 285 is not needed due to non-combustible materials. NFPA 285 generally provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls are required to be non-combustible.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance rating of the floor assembly.

Although some glass and frame technologies have been developed that are capable of passing applicable fire test and building code requirements, there is no system that addresses the exception stated in the International Building Code IBC 2012 Section 715.4 and fulfills the code section ASTM E 2307 full-scale testing.

Due to the increasingly strict requirements regarding fire-resistance, there is a need for a thermally insulating and sealing system for glass curtain wall structure that is capable of meeting or exceeding existing fire test and building code requirements including existing exceptions. In particular, there is a need for systems that prevent the spread of fire when vision glass of a curtain wall structure extends to the finished floor level below. Further, there is a need for systems that address the architectural limitation of the width of a column or spandrel beam or shear wall behind the curtain wall. Additionally, maintaining safing insulation between the floors of a residential or commercial building and the exterior curtain wall responsive to various conditions including fire exposure should be guaranteed.

In view of the above, it is an object of the present invention to provide an offset leg framing element for use in a fire-resistance rated curtain wall construction defined by an interior wall surface including one or more framing members and at least one floor spatially disposed from the interior wall surface of the curtain wall construction, wherein the vision glass of a curtain wall structure extends to the finished floor level below.

Further, it is an object of the present invention to provide a thermally insulating and sealing system for effectively thermally insulating and sealing of a safing slot within a building construction, having a curtain wall construction defined by an interior wall surface including one or more framing members and at least one floor spatially disposed from the interior wall surface of the curtain wall construction, wherein the vision glass of a curtain wall structure extends to the finished floor level below.

Still further, it is an object of the present invention to provide a full-scale ASTM E 2307 tested system for floor assemblies where the vision glass extends to the finished floor level, to address the code exception, to avoid letters and engineering judgments, and to secure and provide defined/tested architectural detail for this application, in particular by providing a tested system for fire safe architectural compartmentation.

Still further, it is an object of the present invention to provide a tested system that provides for integrated and unexposed mullion covers whose thickness ends at the bottom of the floor surface for maximum vision glass exposure. The tested system utilizes no aluminum or faced curtain wall insulation, and the safing insulation can be pre-installed from one side, which maintains the safing insulation between the floors of a residential or commercial building and the glass curtain wall responsive to various conditions, including fire exposure, and maximizes safing insulation at a minimal cost.

Still further, it is an object of the present invention to provide a building construction comprising of such a thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below.

These and other objectives as they will become apparent from the ensuring description of the invention are solved by the present invention as described in the independent claims. The dependent claims pertain to preferred embodiments.

In one aspect, the present invention provides an offset leg framing element for use in a fire-resistance rated curtain wall construction defined by an interior wall surface including one or more framing members and at least one floor spatially disposed from the interior wall surface of the curtain wall construction, wherein vision glass extends to the finished floor level below, comprising a web section having opposing edges; a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and optionally one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls.

In another aspect, the present invention provides a thermally insulating and sealing system for effectively thermally insulating and sealing of a safing slot within a building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor, wherein vision glass extends to the finished floor level below, comprising a first element comprised of a thermally resistant material for insulating positioned in the safing slot, wherein the first element includes an inner primary end surface positionable in abutment with respect to the outer edge of the floor for sealing thereadjacent, an outer primary end surface positionable spatially disposed from the interior wall surface of the curtain wall construction, lower primary facing surface extending between the inner primary end surface and the outer primary end surface and facing downwardly therebetween; a second element comprised of a non-combustible material for receiving the first element positioned substantially in the safing slot in abutment with respect to the bottom of the floor and essentially spatially disposed from the interior wall surface, wherein the second element includes a web section having opposing edges; a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and optionally one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls; and a supplemental element for attaching of the second element with respect to the bottom of the floor.

In yet another aspect, the present invention provides a building construction comprising the thermally insulating and sealing system.

The subject matter of the present invention is further described in more detail by reference to the following figures.

DETAILED DESCRIPTION OF THE DRAWINGS

Figure 1:
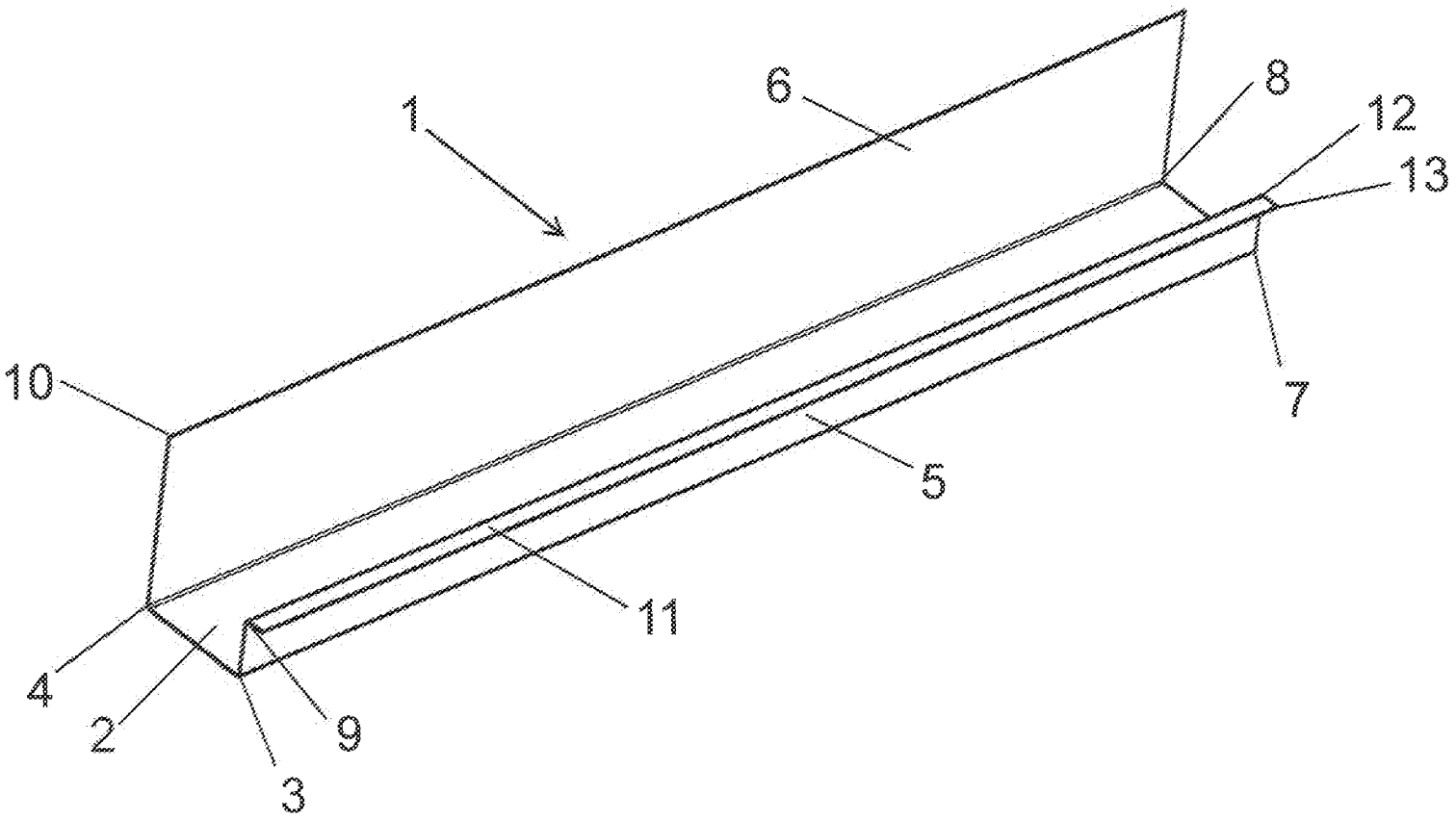
FIG. 1 shows a perspective view of an embodiment of the offset leg framing element (second element)

The following terms and definitions will be used in the context of the present invention.

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" in context with the present invention refers to a wall structure defined by an interior wall surface including one or more framing members and at least one floor spatially disposed from the interior wall surface of the curtain wall construction. In particular this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the of the curtain wall construction as defined above, in particular, to the inner facing surface of the infilled vision glass and the inner facing surface of the framing members.

A glass curtain wall construction or glass curtain wall structure is defined by an interior wall glass surface including one or more framing members and at least one floor spatially disposed from the interior wall surface. Such curtain wall systems commonly include vertical framing members comprising boxed aluminum channels referred to as mullions and similarly configured horizontally extending pieces referred to as transoms. Such a transom located or transom configuration at floor level is also known as zero spandrel, i.e., bottom of the transom at the level as top of the concrete floor. Such glass curtain wall constructions lie within the code exception that the safing slot shall be permitted to be sealed with an approved material to prevent interior spread of fire. However, it has been surprisingly found out that there the thermally insulating and sealing system according to the present invention provides for a system that addresses the code exception and meets the requirements of standard method ASTM E2307, Standard Test Method for Determining Fire Resistance of Perimeter Fire Barriers Using Intermediate-Scale, Multi-story Apparatus, 2015.

The thermally insulating and sealing system according to the present invention is comprised of different elements which provide in accordance with each other for a system that addresses the code exception and meets the requirements of standard method ASTM E2307 and will be described in the following.

The present invention pertains to an offset leg framing element for use in a fire-resistance rated curtain wall construction defined by an interior wall surface including one or more framing members and at least one floor spatially disposed from the interior wall surface of the curtain wall construction. In particular, the present invention pertains to an offset leg framing element for use in a fire-resistance rated curtain wall construction, wherein the curtain wall construction is comprised of a vision glass infill and one or more metal framing members. The offset leg framing element of the present invention is considered for the purpose of facilitating firestopping by receiving and enchasing thermally resistant material positioned in a safing slot present in those buildings utilizing glass curtain wall structures, wherein the vision glass extends to the to the finished floor level, i.e., in the zero spandrel area of a glass curtain wall construction including only vision glass.

The offset leg framing element for use in a fire-resistance rated curtain wall construction according to the present invention, wherein the fire-resistance rated curtain wall construction is defined by an interior wall surface including one or more framing members and at least one floor spatially disposed from the interior wall surface of the curtain wall construction, comprises a) a web section having opposing edges;

b) a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and c) optionally one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls.

In particular, the offset leg framing element is to be used for a curtain wall construction comprised of a vision glass infill and one or more framing members, preferably metal framing members. It is preferred that the offset leg framing element is comprised of non-combustible material, preferably a metal material, most preferably steel.

Moreover, the offset leg framing element is to be used in a curtain wall safing insulation system, in particular in a thermally insulating and sealing system, wherein the system is considered for the purpose of facilitating firestopping of a safing slot present in those buildings utilizing glass curtain wall structures, wherein the vision glass extends to the finished floor level below, i.e., in the zero spandrel area of a glass curtain wall construction including only vision glass.

The thermally insulating and sealing system according to the present invention for effectively thermally insulating and sealing of a safing slot within a building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor, comprises:

i) a first element comprised of a thermally resistant material for insulating positioned in the safing slot, wherein the first element includes:
   a) an inner primary end surface positionable in abutment with respect to the outer edge of the floor for sealing thereadjacent,
   b) an outer primary end surface positionable spatially disposed from the interior wall surface of the curtain wall construction,
   c) a lower primary facing surface extending between the inner primary end surface and the outer primary end surface and facing downwardly therebetween,
ii) a second element comprised of a non-combustible material for encasing the first element positioned substantially in the safing slot in abutment with respect to the bottom of the floor and spatially disposed from the interior wall surface of the curtain wall construction, wherein the second element includes:
   a) a web section having opposing edges;
   b) a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and
   c) optionally one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls, and
iii) a supplemental element for attaching of the second element with respect to the bottom of the floor.

In particular, the first element according to the present invention includes an inner primary end surface positionable in abutment with respect to the outer edge of the floor for sealing thereadjacent. Furthermore, the first element includes an outer primary end surface positionable spatially disposed from the interior wall surface of the curtain wall construction. Moreover, the first element includes a lower primary facing surface extending between the inner primary end surface and the outer primary end surface and facing downwardly therebetween, preferably spatially disposed from the inner facing surface of one of the pair of outwardly extending sidewalls of the second element.

It is preferred that the first element comprises a thermally resistant material for insulating positioned in the safing slot, preferably a thermally resistant flexible material such as a mineral wool material, to facilitate placement thereof into the safing slot adjacent one another.

In a particular preferred embodiment of the present invention, the thermally resistant flexible mineral wool material is installed with fibers running parallel to the outer edge of the floor. Moreover, it is preferred that a min. 4 inch thick, 4-pcf density, mineral wool bat insulation is employed in the system of the present invention and most preferably installed with 25% compression.

The second element of the thermally insulating and sealing system according to the present invention is preferably positioned spatially disposed from the interior wall surface of the curtain wall construction and spatially disposed from the lower facing surface of the first element, and extends across the sating slot toward the outer edge of the floor thereadjacent. The second element facilitates receiving, enchasing and holding in place the insulation material of the curtain wall construction and maintains for complete sealing of the safing slot in case of a fire.

It is preferred that the second element of the thermally insulating and sealing system is comprised of a non-combustible material, preferably a metal material, most preferably steel. In a particular preferred embodiment of the present invention, the second element is an 18 gauge metal sheet. Dimensions and geometric design of the second element may be varied and adapted to address joint width and transom location in a degree known to a person skilled in the art.

According to the present invention, the thermally insulating and sealing system comprises a supplemental attachment element for attaching of the second element with respect to the bottom of the floor.

It is preferred that the supplemental attachment element comprises at least one supplemental attachment device, such as at least one structural fastening element. The structural fastening element may be any element suitable for fastening, such as a pin, an expansion anchor, screw anchor, bolt, or adhesion anchor. However, any other attachment devices may be used to attach the second element according to the present invention.

It is preferred that the structural fastening element extends through the second element and is attached to the bottom of the floor and optionally to an interior horizontal framing member of the curtain wall construction. However, any other suitable attachment region may be chosen as long as maintenance of complete sealing of the safing slot is guaranteed.

According to the present invention, the thermally insulating and sealing system may further comprise a third element comprised of a thermally resistant material for insulating positioned in the safing slot in abutment with respect to the outer primary end surface of the first element and in abutment to the interior of the web section of the second element and partially to the inner facing surfaces of the outwardly extending sidewalls of the second element.

It is preferred that the third element comprises a thermally resistant material for insulating positioned in the safing slot, preferably a thermally resistant flexible material such as a mineral wool material, to facilitate placement thereof into the safing slot adjacent one another.

In a particular preferred embodiment of the present invention, the thermally resistant flexible mineral wool material is installed with fibers running parallel to the interior web section of the second element. Moreover, it is preferred that a min. 3 inch thick, 8-pcf density, mineral wool bat insulation, i.e., unfaced curtain wall insulation material is employed in the system of the present invention.

It is most preferred that the first element and the third element each comprise a thermally resistant flexible material, preferably a mineral wool material, to facilitate placement thereof into the safing slot adjacent one another. The first and third element facilitate maintaining of abutment within the second element and hence responsive to thermal deforming of the interior wall surface.

According to the present invention, the thermal insulating and sealing system may further comprise a connecting framing element, preferably a metal plate, which is positioned between the second element and the bottom of the floor in front of the vertical framing member to maintain complete sealing of the safing slot. Preferably, the connecting framing element is positioned underneath one of the outwardly extending sidewalls of the second element thereby closing the gap between the outwardly extending sidewalls of the second element spatially disposed from each other due to the architectural structure of the glass curtain wall assembly.

It is preferred that the connecting framing element of the thermally insulating and sealing system is comprised of a non-combustible material, preferably a metal material, most preferably steel. In a particular preferred embodiment of the present invention, the connecting framing element is rectangular 14 inch metal plate. Dimensions and geometric design of the connecting framing element may be varied and adapted to address joint width and mullion location in a degree known to a person skilled in the art.

In a preferred embodiment of the present invention, the connecting framing element has attachment regions for facilitating attachment with respect to the bottom of the floor and the second element in front of the vertical framing member. Preferably, the supplemental attachment element of the thermally insulating and sealing system, comprising at least one supplemental attachment device as defined above, extends through the second element and connecting framing element and is attached to the bottom of the floor. However, any other suitable attachment region may be chosen as long as maintenance of complete sealing of the safing slot is guaranteed.

According to the present invention, the thermal insulating and sealing system may further comprise an additional element comprised of a thermally resistant material for insulating positioned in the safing slot in abutment with respect to the lower facing surface of the first element and to the upper facing surface of one of the outwardly extending sidewalls of the second element.

It is preferred that the additional element comprises a thermally resistant material for insulating positioned in the safing slot, preferably a thermally resistant flexible material such as a mineral wool material, to facilitate placement thereof into the safing slot adjacent one another.

In a particular preferred embodiment of the present invention, the thermally resistant flexible mineral wool material is installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

The additional element is preferably centered in front of the vertical framing member overlapping the inner facing surface of one of the outwardly extending sidewalls one of the second element and is positioned in the safing slot in abutment with respect to the lower facing surface of the first element and to the upper facing surface of one of the outwardly extending sidewalls of the second element. The additional element includes an inner end surface positionable in abutment with respect to the outer edge of the floor for sealing thereadjacent, an outer end surface positionable in abutment with respect to the inner facing surface of the vertical framing member, a lower facing surface extending between the inner end surface and the outer end surface and facing downwardly therebetween, positionable in abutment with respect to inner facing surface of the connecting framing element and in abutment with respect to the inner facing surface of one of the outwardly extending sidewalls of the second element, and an upper facing surface extending between the inner end surface and the outer end surface and facing upwardly therebetween, positionable in abutment with respect to the lower primary facing surface extending between the inner primary end surface and the outer primary end surface and facing downwardly of the first element.

In a particular preferred embodiment of the present invention, the thermally resistant flexible mineral wool material of the first element is installed continuously and in abutment with respect to the outer edge of the floor and the third element, the inner facing surface of the vertical framing member and to the upper facing surface extending between the inner end surface and the outer end surface of the additional element, respectively.

According to the present invention, the thermally insulating and sealing system may further comprise an outer fire retardant coating positioned across the first element and the adjacent portions of the interior framing member of the curtain wall construction and the floor located thereadjacent. The sealing characteristics of the construction shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicon sealants. For example, Hilti Firestop Joint Spray CFS-SP WB can be used as an outer fire retardant coating in accordance with the present invention. In one preferred embodiment of the present invention the outer fire retardant coating is a water-based or silicone-based outer fire retardant coating, preferably a firestop joint spray. The outer fire retardant coating that can be applied in the system of the present invention is preferably in the form of an emulsion, spray, coating, foam, paint or mastic.

According to one embodiment of the present invention, it is preferred that the outer fire retardant coating has a wet film thickness of at least ⅛ inch. Additionally, it is preferable that the outer fire retardant coating covers the top of the thermally resistant flexible mineral wool material overlapping the outer edge of the floor and the interior face of the interior framing member surface of the curtain wall construction by a min. of ½ inch. The outer fire retardant material can be applied across the first element and the adjacent areas of the interior wall surface and floor.

According to the present invention, the thermally insulating and sealing system may further comprise a silicon sealant, preferably a firestop silicon, within the inner facing surface of the second element and at the corner adjacent to the inner lower edge of transom in order to restrict air movement and to serve as a vapor barrier. Moreover, the application of a silicon sealant allows the usage of an unfaced curtain wall insulating material, i.e., mineral without any foil or tape around the outside. Usually, it is common practice to use a faced curtain wall insulating material.

According to the present invention, the thermally insulating and sealing system is initially installed within the zero spandrel area of a glass curtain wall construction.

In a first step, the offset leg framing element (second element) is located temporally to concrete and the horizontal framing member (transom located at floor level) between the vertical framing members (mullions). Preferably, a silicon sealant is pre-applied, preferably a firestop silicon, for example silicon sealant Hilti CFS-S SIL GG, within the inner facing surface of the offset leg framing element (second element) and at the corner adjacent to the inner lower edge of transom in order to restrict air movement and to serve as a vapor barrier.

In a second step, the offset leg framing element (second element) is secured with the supplemental attachment element, preferably with self-drilling screws, to the horizontal framing member (transom), preferably with the ledge onto the inner facing horizontal framing member surface (transom surface). However, it is also possible to secure the offset leg framing element (second element) with the supplemental attachment element to the horizontal framing member (transom) with one of the outwardly extending sidewalls onto the vertical downwardly facing horizontal framing member surface (transom surface).

In a third step, a connecting framing element, preferably a metal sheet, is located between the offset leg framing element (second element) and the bottom of the concrete floor in front of the vertical framing member (mullion). Preferably, the connecting framing element is positioned underneath one of the outwardly extending sidewalls of the second element thereby closing the gap between the outwardly extending sidewalls of the second element spatially disposed from each other due to the architectural structure of the glass curtain wall assembly.

In a fourth step, the offset leg framing element (second element) and the connecting framing element are secured with the supplemental attachment element, preferably with a concrete anchoring element to the bottom of the floor, thereby securing and fastening the connecting framing element at the vertical framing member (mullion).

In a fifth step, the connecting framing element is sealed to the vertical framing member (mullion) using a silicon sealant, such as silicon sealant Hilti CFS-S SIL GG.

In a sixth step, the third element, preferably 8-pcf density, unfaced mineral wool—also referred to as unfaced curtain wall insulation —, is friction-fitted into the offset leg framing element (second element) between the vertical framing members (mullions).

In a seventh step the additional element, preferably mineral wool of 12 inch long sections, is installed with 25% compression and centered at the inner facing surface of one of the outwardly extending sidewalls one of the offset leg framing element (second element) in front of the vertical framing members (mullions).

In an eighth step, the first element, preferably mineral wool mineral wool with 4 inch depth is continuously installed with 25% compression into the safing slot with its inner primary end surface positioned in abutment with respect to the outer edge of the floor for sealing thereadjacent, with its outer primary end surface in direct abutment with the third element, the inner facing surface of the vertical framing member and to the upper facing surface extending between the inner end surface and the outer end surface of the additional element, respectively, and with its lower primary facing surface extending between the inner primary end surface and the outer primary end surface and facing downwardly therebetween, spatially disposed from the upper facing surface of one of the outwardly extending sidewalls of the offset leg framing element (second element) and in abutment with respect to the additional element.

In a ninth step, a fire retardant coating is applied across the first element and the adjacent portions of the interior framing member of the curtain wall construction and the floor located thereadjacent. The fire retardant coating, in particular the outer fire retardant coating, may be for example a silicon-base fire retardant coating, such as Hilti CFS-SP WB or SIL firestop joint spray having a wet thickness of at least ⅛ inch and overlapping the outer edge of the floor and the interior face of the interior framing member surface of the curtain wall construction by a min. of ½ inch.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

The thermally insulating and sealing system according to the present invention is preferably for use with a building construction having a wall construction defined by an interior wall surface including one or more framing members and at least one floor spatially disposed from the interior wall surface of the curtain wall construction defining the safing slot extending between the interior wall surface of the curtain wall construction and an outer edge of the floor.

In particular, the building construction comprises a thermally insulating and sealing system for effectively thermally insulating and sealing of the safing slot, wherein the thermal insulating and sealing means comprises:

i) a first element comprised of a thermally resistant material for insulating positioned in the safing slot, wherein the first element includes:
   a) an inner primary end surface positionable in abutment with respect to the outer edge of the floor for sealing thereadjacent,
   b) an outer primary end surface positionable spatially disposed from the interior wall surface of the curtain wall construction,
   c) a lower primary facing surface extending between the inner primary end surface and the outer primary end surface and facing downwardly therebetween, ii) a second element comprised of a non-combustible material for receiving the first element positioned substantially in the safing slot in abutment with respect to the bottom of the floor and essentially spatially disposed from the interior wall surface of the curtain wall construction, wherein the second element includes:
   a) a web section having opposing edges;
   b) a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and
   c) optionally one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls, wherein the second element is positioned spatially disposed from the interior wall surface of the curtain wall construction and spatially disposed from the lower facing surface of the first element, and extends across the safing slot toward the outer edge of the floor thereadjacent, iii) a supplemental element for attaching of the second element with respect to the bottom of the floor, iv) a third element comprised of a thermally resistant material for insulating positioned in the safing slot in abutment with respect to the outer primary end surface of the first element and in abutment to the interior of the web section of the second element and partially to the inner facing surfaces of the outwardly extending sidewalls of the second element, v) a connecting framing element of a non-combustible material, positioned between the second element and the bottom of the floor in front of a vertical framing member.

vi) an additional element comprised of a thermally resistant material for insulating positioned in the safing slot in abutment with respect to the lower facing surface of the first element and to the upper facing surface of one of the outwardly extending sidewalls of the second element, and vii) an outer fire retardant coating positioned across the first element and the adjacent portions of the interior framing member of the curtain wall construction and the floor located thereadjacent.

It is preferred that the building construction comprises a curtain wall construction which is comprised of a vision glass infill and one or more metal framing members.

While the invention is particularly pointed out and distinctly described herein, a preferred embodiment is set forth in the following detailed description which may be best understood when read in connection with the accompanying drawings.

In FIG. 1 is shown a perspective view of an embodiment of the offset leg framing element 1 (second element) for use in a fire-resistance rated glass curtain wall construction. The offset leg framing element 1 has a web section 2 having opposing edges 3 and 4; a pair of outwardly extending sidewalls 5 and 6 integrally connected to the web section 2, wherein each sidewall 5 and 6 has a proximal 7 and 8 end and a distal end 9 and 10, wherein the proximal end 7 and 8 of each sidewall 5 and 6 is integrally connected to one of the opposing edges 3 and 4 of the web section 2, and wherein the sidewalls 5 and 6 are substantially parallel and confront each other; and one laterally extending ledge section 11 integrally connected to one of the pair of outwardly extending sidewalls 5, wherein the ledge section 11 has an inner edge 12 and an outer edge 13, and wherein the inner edge 12 of the ledge section 11 is integrally connected to the distal end 9 of one of the pair of sidewalls 5.

Figure 2:
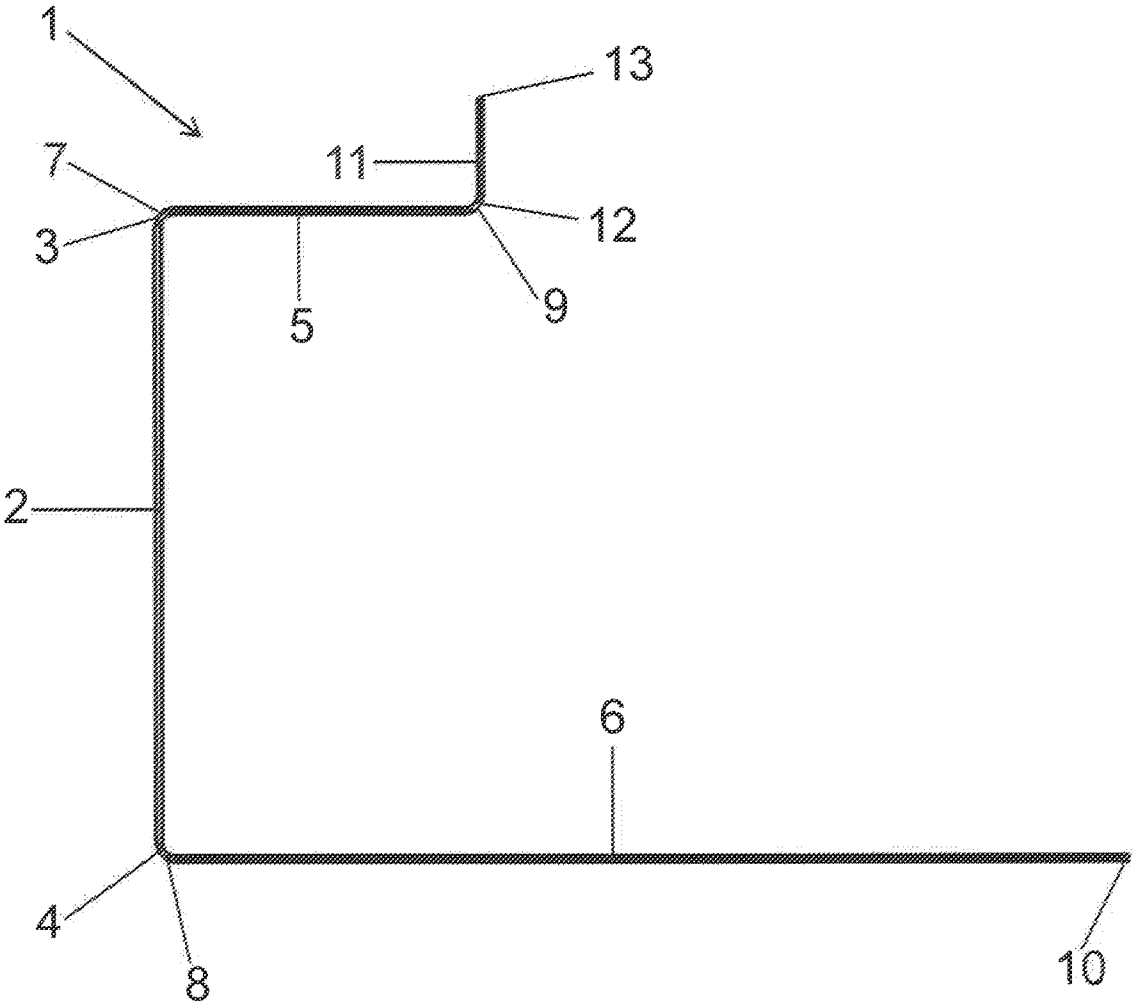
FIG. 2 shows a side cross-sectional view of the offset leg framing element (second element) as shown in FIG. 1.

In FIG. 2 is shown a side cross-sectional view of the offset leg framing element (second element) having a web section 2 having opposing edges 3 and 4; a pair of outwardly extending sidewalls 5 and 6 integrally connected to the web section 2, wherein each sidewall 5 and 6 has a proximal 7 and 8 end and a distal end 9 and 10, wherein the proximal end 7 and 8 of each sidewall 5 and 6 is integrally connected to one of the opposing edges 3 and 4 of the web section 2, and wherein the sidewalls 5 and 6 are substantially parallel and confront each other; and one laterally extending ledge section 11 integrally connected to one of the pair of outwardly extending sidewalls 5, wherein the ledge section 11 has an inner edge 12 and an outer edge 13, and wherein the inner edge 12 of the ledge section 11 is integrally connected to the distal end 9 of one of the pair of sidewalls 5.

Figure 3:
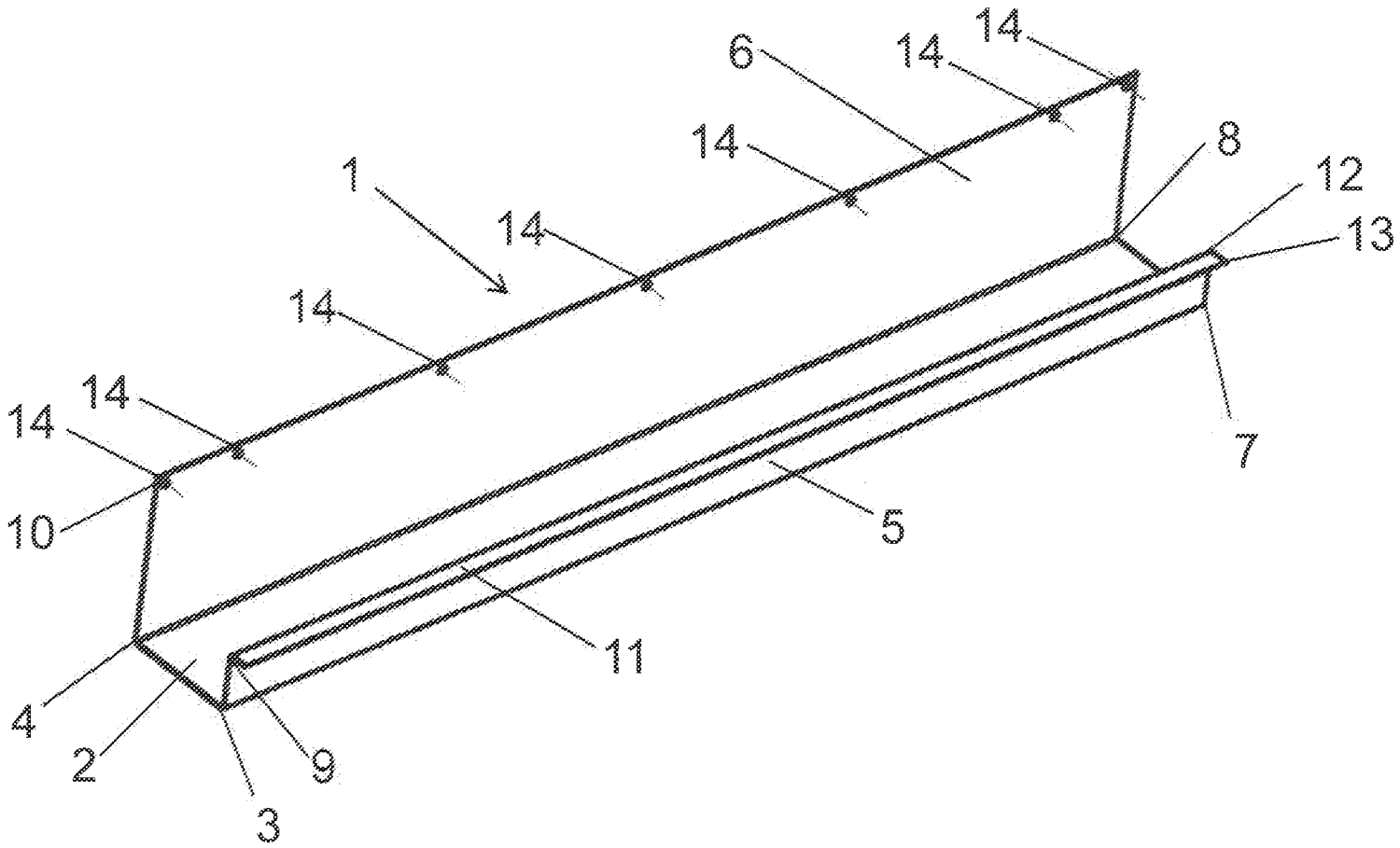
FIG. 3 shows a perspective view of an embodiment of the offset leg framing element (second element) including holes for facilitating attachment.

In FIG. 3 holes 14 for facilitating attachment of the offset leg framing element (second element) are depicted in a perspective view of an embodiment of the offset leg framing element (second element).

Figure 4:
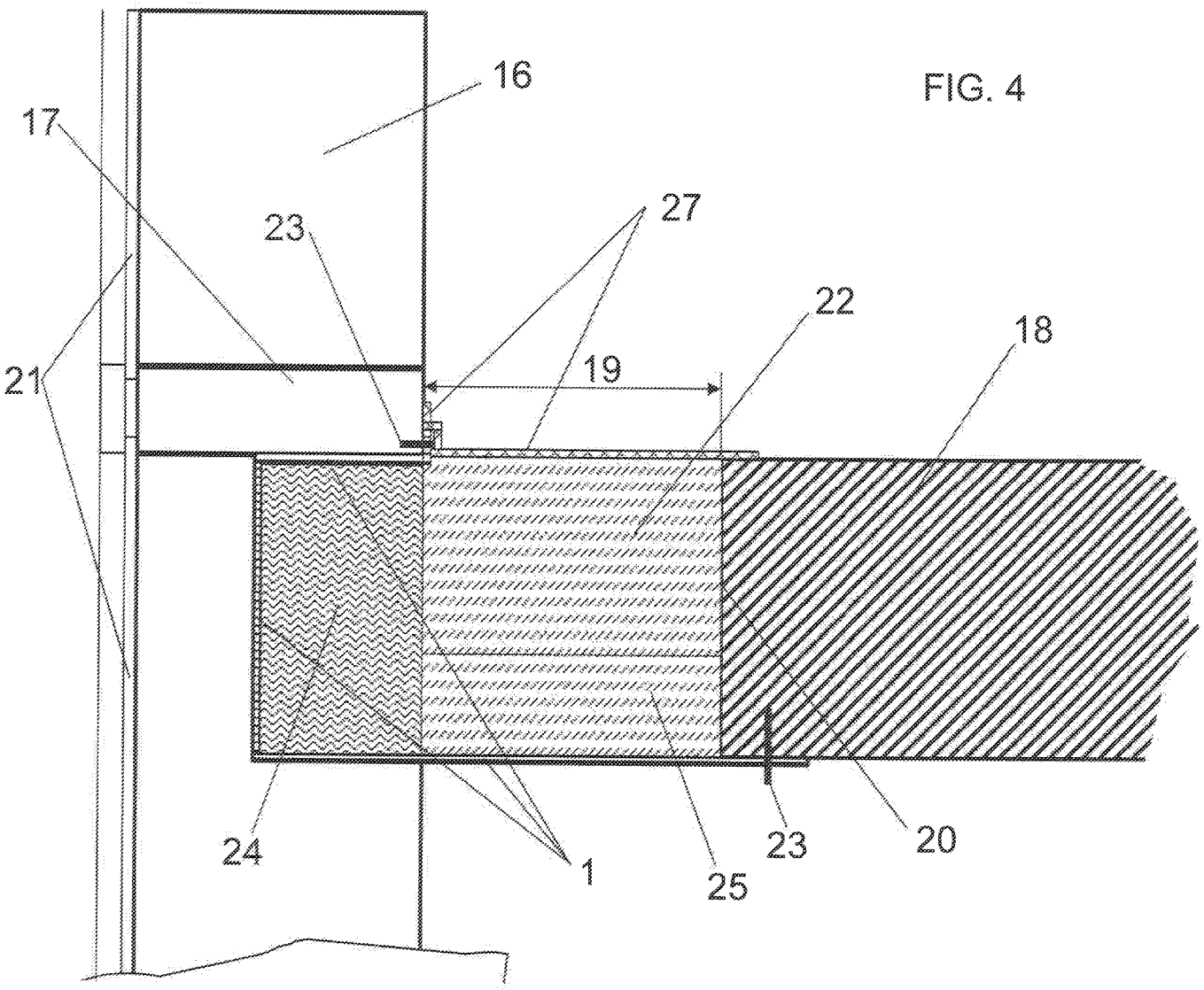
FIG. 4 shows a side cross-sectional overall view of an embodiment of the thermally insulating and sealing system between the outer edge of a floor and the interior wall surface when initially installed in a curtain wall construction, wherein the vision glass extends to the finished floor level below.

In FIG. 4 a side cross-sectional view of the thermally insulating and sealing system between the outer edge of a floor and the interior wall surface is shown, when initially installed in a curtain wall construction, wherein the vision glass extends to the finished floor level below—glass curtain wall construction. In particular, the thermally insulating and sealing system is initially installed within the zero spandrel area of a glass curtain wall construction, defined by an interior wall surface 15 including one or more framing members, i.e., vertical framing member—mullion 16—and horizontal framing member—transom 17—which is located at the floor level, and at least one floor 18 spatially disposed from the interior wall surface 15 of the curtain wall construction defining the safing slot 19 extending between the interior wall surface 15 of the curtain wall construction and an outer edge 20 of the floor. The framing members 16 and 17 are infilled with vision glass 21 extending to the finished floor level below. The thermally insulating and sealing system of the present invention comprises a first element 22 for insulation, an offset leg framing element 1 (second element) for receiving and a supplemental attachment element 23 for attaching of the offset leg framing element 1 (second element) with respect to the bottom 28 of the floor 18. Further, the thermally insulating and sealing system of the present invention comprises a third element 24 for insulating in between mullions 16 and an additional element 25 for insulation at the mullion 16. Also, the thermally insulating and sealing system of the present invention comprises a connecting framing element 26 (not shown in FIG. 4) for receiving the additional element 25 at the mullion 16. In FIG. 4, an outer fire retardant coating 27 is positioned across the first element 22 and the adjacent portions of the interior framing member 16 and 17, respectively, and the floor 18 located thereadjacent in order to further maintain a complete seal extending within the safing slot 19 in those conditions where the interior wall surface 15 has expanded beyond the lateral expansion capability of the insulating elements.

Figure 5:
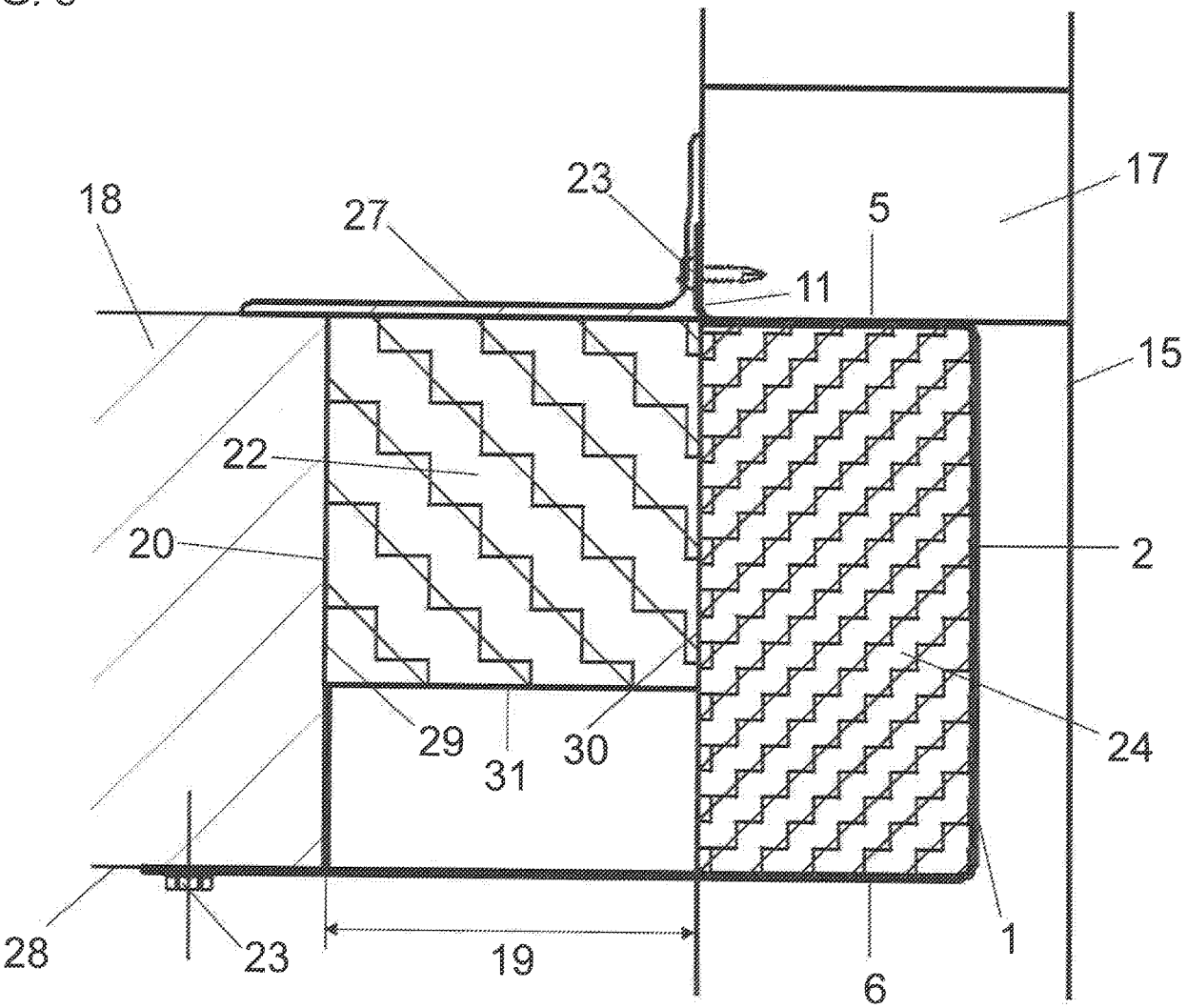
FIG. 5 shows a side cross-sectional view of an embodiment of the thermally insulating and sealing system between the outer edge of a floor and the interior wall surface when initially installed and attached to a horizontal framing member (transom at floor level, i.e. zero spandrel) and the bottom of the floor in a curtain wall construction, wherein the vision glass extends to the finished floor level below.

In FIG. 5 a side cross-sectional view of an embodiment of the thermally insulating and sealing system between the outer edge of a floor and the interior wall surface is shown, in particular in between the vertical framing members (mullions), when initially installed and attached to a horizontal framing member (transom at floor level, i.e. zero spandrel) and the bottom of the floor in a curtain wall construction, wherein the vision glass extends to the finished floor level below. In particular, the offset leg framing element 1 (second element) is positioned substantially in the safing slot 19 in abutment with respect to the bottom 28 of the concrete floor 18 and essentially spatially disposed from the interior wall surface 15 of the glass curtain wall construction. The first element 22 is comprised of a thermally resistant material, such as mineral wool, and installed at a min. of 4 inch depth and continuously across the safing slot 19 with 25% compression for insulating. The first element 22 includes an inner primary end surface 29 positionable in abutment with respect to the outer edge 20 of the floor 18 for sealing thereadjacent, an outer primary end surface 30 positionable spatially disposed from the interior wall 15 surface of the curtain wall construction, and lower primary facing surface 31 extending between the inner primary end surface 29 and the outer primary end 30 surface and facing downwardly therebetween, and positionable spatially disposed from the inner facing surface of one of the pair of outwardly extending 6 sidewalls of the second element. The offset leg framing element 1 (second element) is positioned spatially disposed from the interior wall surface 15 of the curtain wall construction and spatially disposed from the lower facing surface 31 of the first element 22, and extends across the safing slot 19 toward the outer edge 20 of the floor 18. The third element 24 is comprised of a thermally resistant material for insulating, such as mineral wool, preferably a min. 8-pcf density unfaced curtain wall insulation having a thickness of 3 inch, and installed within the chasing (crimp) of the offset leg framing element 1 (second element), defined by the web section 2 and parts of the outwardly extending sidewalls 5 and 6, in the safing slot 19 in abutment with respect to the outer primary end surface 30 of the first element 22 and in abutment to the interior of the web section 2 of the offset leg framing element 1 (second element) and to the inner facing surfaces of the outwardly extending sidewalls 5 and 6 of the offset leg framing element 1 (second element). Not shown in FIG. 5 is that the thermally resistant flexible mineral wool material is installed with fibers running parallel to the outer edge of the floor 20 and the interior web section 2 of the offset leg framing element 1 (second element). The offset leg framing element 1 (second element) is attached to the bottom 28 of the floor 18 and to the interior horizontal framing member 17 (transom) of the curtain wall construction using a structural fastening element 23, in particular a screw or screw anchor, thereby extending through the offset leg framing element 1 (second element). In FIG. 5, an outer fire retardant coating 27 is positioned across the first element 22 and the adjacent portions of the interior framing member 17, and the floor 18 located thereadjacent in order to further maintain a complete seal extending within the safing slot 19 in those conditions where the interior wall surface 15 has expanded beyond the lateral expansion capability of the insulating elements.

Figure 6:
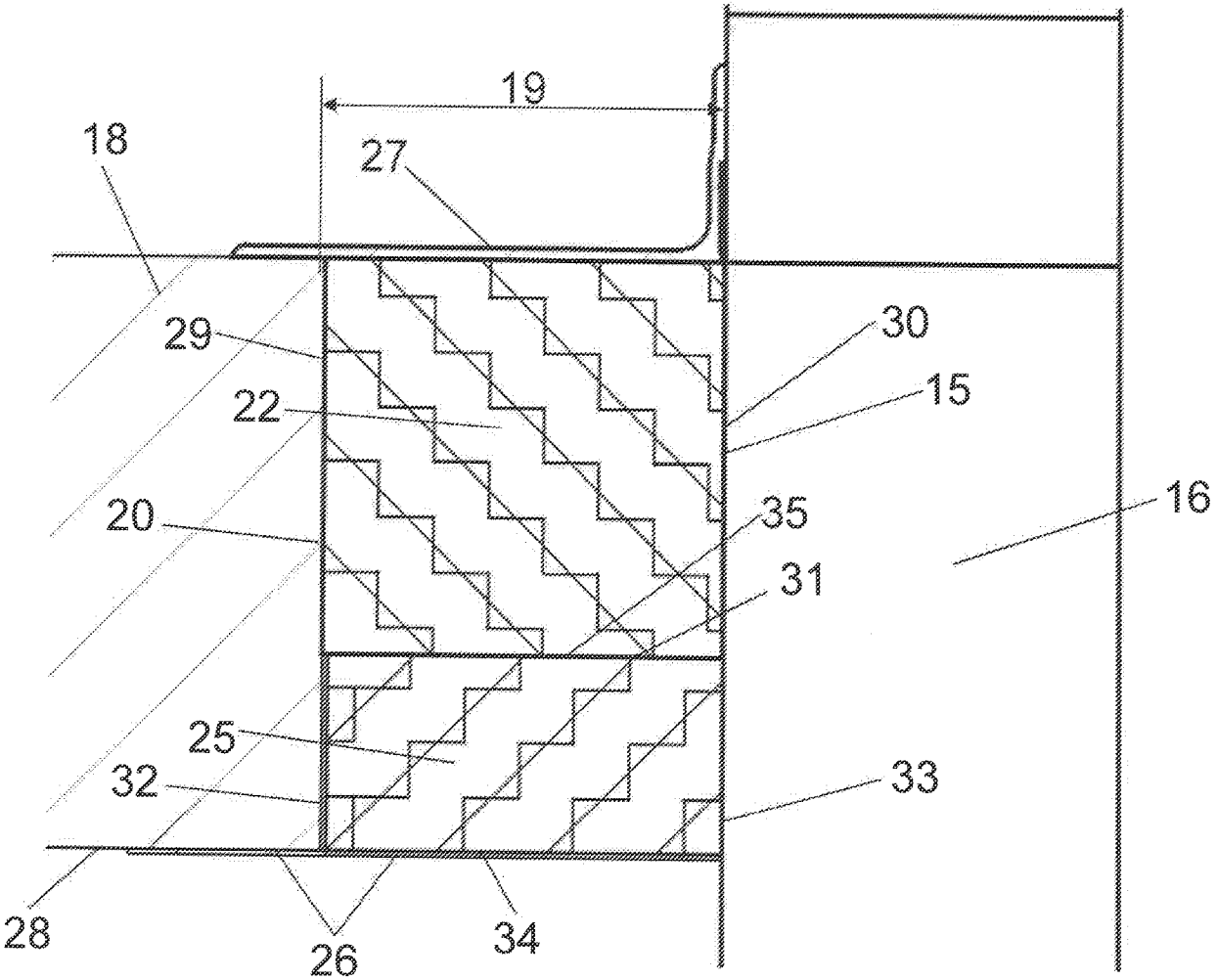
FIG. 6 shows a side cross-sectional view of an embodiment of the thermally insulating and sealing system between the outer edge of a floor and a vertical framing member (mullion) when initially installed in a curtain wall construction, wherein the vision glass extends to the finished floor level below.

In FIG. 6 a side cross-sectional view of an embodiment of the thermally insulating and sealing system between the outer edge of a floor and a vertical framing member (mullion) is shown, in particular at the vertical framing member (mullion), when initially installed in a curtain wall construction, wherein the vision glass extends to the finished floor level below. In particular, the thermally insulating and sealing system of the present invention further comprises a connecting framing element 26, preferably a metal plate, which is positioned between the offset leg framing element 1 (second element) and the bottom 28 of the concrete floor 18 in front of the vertical framing member 16 (mullion) to maintain complete sealing of the safing slot 19. Preferably, the connecting framing element 26 is positioned underneath one of the outwardly extending sidewalls 6 of the offset leg framing element 1 (not shown in FIG. 6, but refer to FIG. 9), thereby closing the gap between the outwardly extending sidewalls 6 of the offset leg framing elements 1 spatially disposed from each other due to the architectural structure of the glass curtain wall assembly. The connecting framing element 26 preferably has attachment regions for facilitating attachment with respect to the bottom 28 of the floor 18 and the offset leg framing element 1 (second element) in front of the vertical framing member 16 (mullion). Further, the thermally insulating and sealing system of the present invention comprises an additional element 25 comprised of a thermally resistant material, preferably mineral wool having a length of 12 inch, which is installed with 25% compression and centered in front of the vertical framing member 16 (mullion) overlapping the inner facing surface of one of the outwardly extending sidewalls 6 one of the offset leg framing element 1 (second element) (not shown) and is positioned in the safing slot in abutment with respect to the lower facing surface 31 of the first element 22 and to the upper facing surface of one of the outwardly extending sidewalls 6 of the offset leg framing element 1 (second element). The additional element 25 includes an inner end surface 32 positionable in abutment with respect to the outer edge 20 of the floor 18 for sealing thereadjacent, an outer end surface 33 positionable in abutment with respect to the inner facing surface of the vertical framing member 16 (mullion), a lower facing surface 34 extending between the inner end surface 32 and the outer end surface 33 and facing downwardly therebetween, positionable in abutment with respect to inner facing surface of the connecting framing element 26 and in abutment with respect to the inner facing surface of one of the outwardly extending sidewalls 6 one of the offset leg framing element 1 (second element), and an upper facing surface 35 extending between the inner end surface 32 and the outer end surface 33 and facing upwardly therebetween, positionable in abutment with respect to the lower primary facing surface 31 extending between the inner primary end surface 29 and the outer primary end 30 surface and facing downwardly of the first element 22. In FIG. 6, an outer fire retardant coating 27 is positioned across the first element 22 and the adjacent portions of the interior framing member 16, and the floor 18 located thereadjacent in order to further maintain a complete seal extending within the safing slot 19 in those conditions where the interior wall surface 15 has expanded beyond the lateral expansion capability of the insulating elements.

Figure 7:
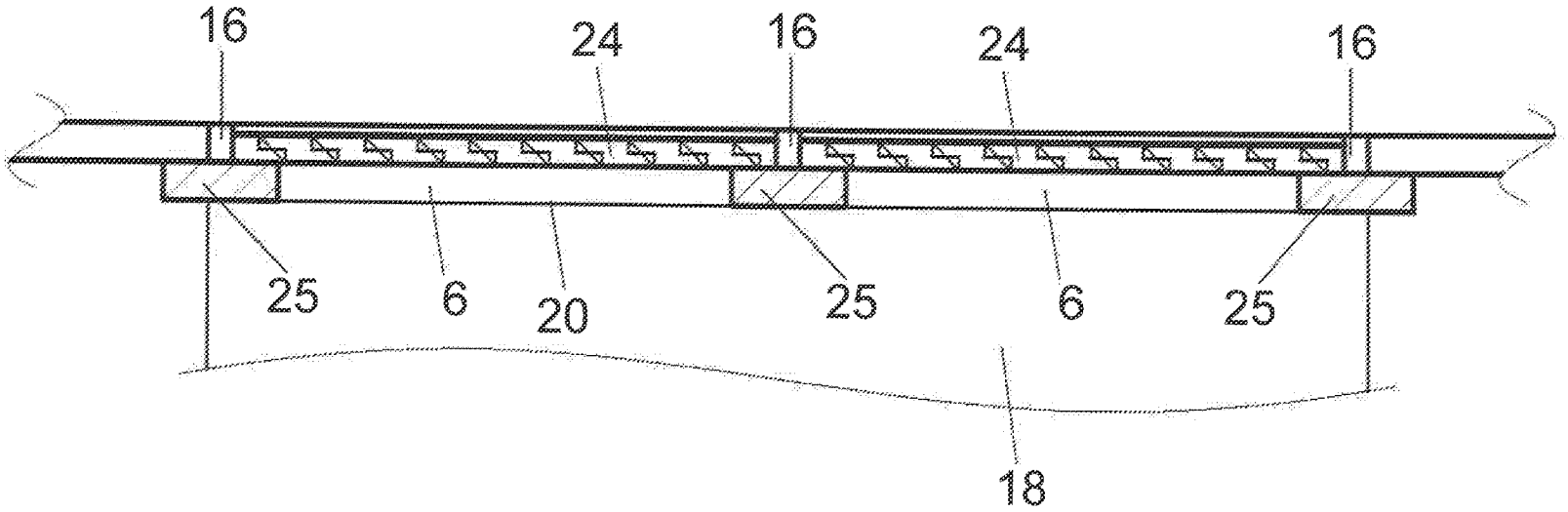
FIG. 7 shows a top view of an embodiment of the thermally insulating and sealing system at the mullion cover level when initially installed in a curtain wall construction, wherein the vision glass extends to the finished floor level below.

FIG. 7 shows a top view of an embodiment of the thermally insulating and sealing system at the mullion cover level when initially installed in a curtain wall construction, wherein the vision glass extends to the finished floor level below. The additional element 25 is positioned centered in front of the vertical framing member 16 (mullion), i.e., in abutment with respect to the to the inner facing surface of the vertical framing member 16 (mullion), overlapping the inner facing surface of one of the outwardly extending sidewalls 6 one of the offset leg framing element 1 (second element) and in abutment with respect the outer edge 20 of the floor 18 and the third element 24.

Figure 8:
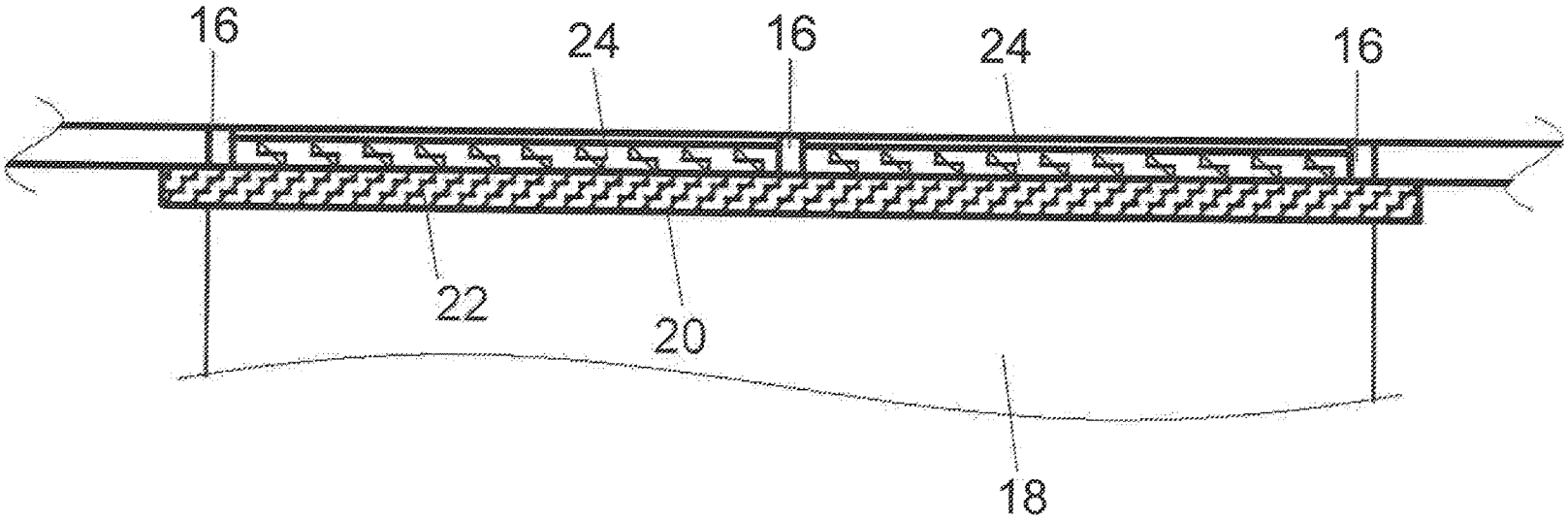
FIG. 8 shows a top view of an embodiment of the thermally insulating and sealing system at the slap surface when initially installed in a curtain wall construction, wherein the vision glass extends to the finished floor level below.

FIG. 8 shows a top view of an embodiment of the thermally insulating and sealing system at the slap surface when initially installed in a curtain wall construction, wherein the vision glass extends to the finished floor level below. The first element 22 is installed continuously and in abutment with respect to the outer edge 20 of the floor 18 and the third element 24, the inner facing surface of the vertical framing member 16 (mullion), and to the upper facing surface 35 extending between the inner end surface 32 and the outer end surface 33 of the additional element 26, respectively.

Figure 9:
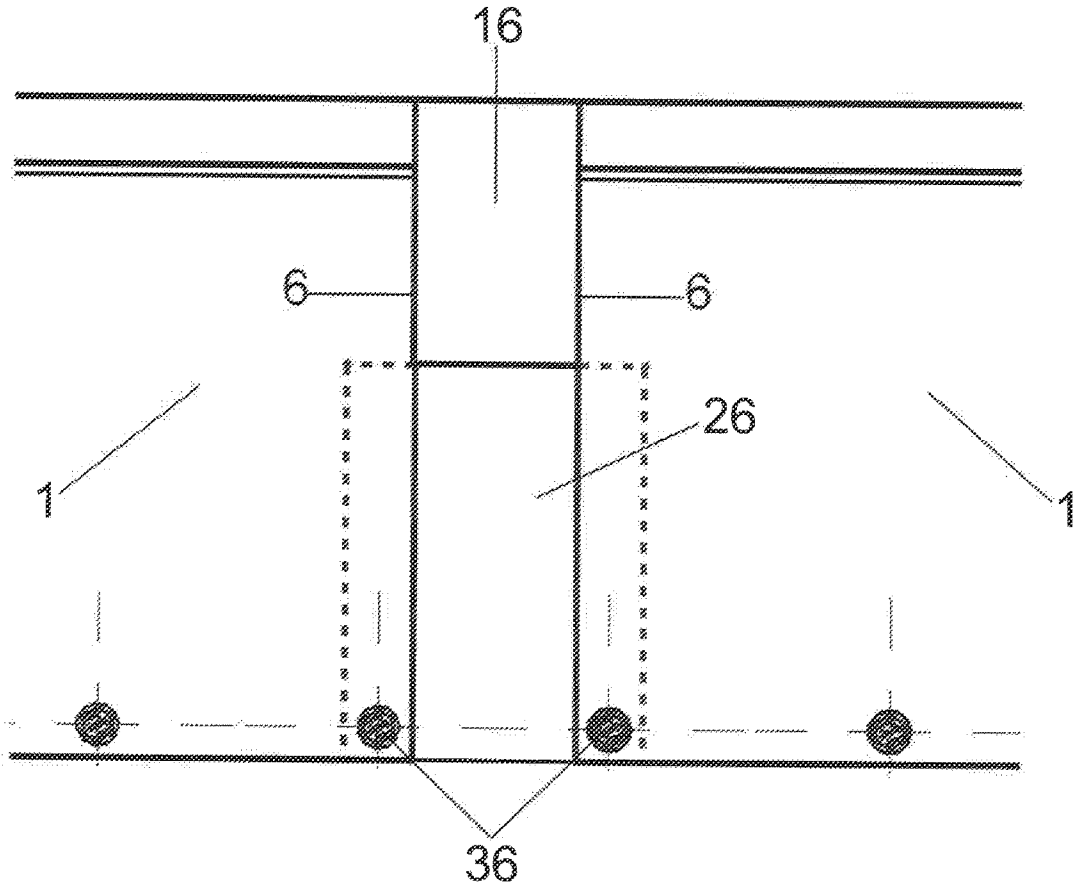
FIG. 9 shows a bottom view of an embodiment of the thermally insulating and sealing system when initially installed at a vertical framing member (mullion) in a curtain wall construction, wherein the vision glass extends to the finished floor level below.

FIG. 9 shows a bottom view of an embodiment of the thermally insulating and sealing system when initially installed at a vertical framing member (mullion) in a curtain wall construction, wherein the vision glass extends to the finished floor level below. The connecting framing element 26 is positioned between the offset leg framing element 1 (second element) and the bottom 28 of the concrete floor 18 (not shown) in front of the vertical framing member 16 (mullion) to maintain complete sealing of the safing slot 19.

The connecting framing element 26 is positioned underneath one of the outwardly extending sidewalls 6 of the offset leg framing element 1 thereby closing the gap between the outwardly extending sidewalls 6 of the offset leg framing elements 1 spatially disposed from each other due to the architectural structure of the glass curtain wall assembly. The connecting framing element 26 has attachment regions 36 for facilitating attachment with respect to the bottom 28 of the floor 18 and the offset leg framing element 1 (second element) in front of the vertical framing member 16 (mullion) using supplemental attachment elements 23 thereby butting up against the vertical framing member 16 (mullion).

It should be appreciated that these embodiments of the present invention will work with many different types of insulating materials used for the first element, third element and/or the additional element as long as the material has effective high temperature insulating characteristics.

The thermally insulating and sealing system of the present application has been subject to a test (Intertek Design No. HI-BPF 120-10) according to standard method ASTM E2307, Standard Test Method for Determining Fire Resistance of Perimeter Fire Barriers Using Intermediate-Scale, Multi-story Apparatus, 2015, as follows.

Elements and Assembly Description

1. Concrete Lab Floor, 2 Hour Fire-Rating):
6 inch thick reinforced normal weight 3000 psi concrete slab. There was a 4 inch open joint (safing slot) from wall to slab. This opening was filled with 4 inch thick 4-pcf density mineral wool installed with 25% compression (first element) (Thermafiber Firespan).

2. Curtain Wall (Non Fire-Rated, 0 Hours Fire-Rated):
Curtain wall constructed of rectangular hollow tubing 2½ inch wide and 4 inch deep (total depth of wall including ¼ inch glass and ½ inch aluminum cap is 5¼ inch), made from 0.1 inch thick aluminum (framing members). ¼ inch thick tempered glass (vision glass) was installed in place with aluminum compression plates (caps) and glazing gaskets.

3. Galvanized Sheet Metal Pan (Second Element—Artificial Spandrel):
Galvanized steel pan made from 18 gauge galvanized steel was attached to the aluminum framing with No. 10 self-drilling sheet metal screws at 12 inch on center and to the concrete slap with Hilti Kwik HUS-EZ ¼ inch×1⅞ inch steel concrete anchors, also 12 inch on center. The galvanized steel pan was formed such that it could contain 3 inch of curtain wall insulation (third element) as well as the 4 inch joint (safing slot).

4. Firestop Silicone (Firestop Silicone Sealant):
Hilti CFS-S SIL GG Firestop Silicone was installed along the edges of the artificial spandrel (second element) that was in contact with the aluminum members (framing members) of the curtain wall assembly.

5. Curtain Wall Insulation (Third Element):
3 inch thick, 6 inch tall sections of 8-pcf density mineral wool with foil face removed—unfaced curtain wall insulation (third element) (Thermafiber Firespan)—were installed into the artificial spandrel (second element) along the length of the curtain wall assembly between the aluminum mullions (vertical framing members).

6. Joint Packing Material (First Element):
4 foot long, 4 inch thick mineral wool of 4-pcf density (Thermafiber Safing) was packed into the width of the joint flush with the top surface of the floor at −25% compression. Strips were installed so that the factory compressed layers of the safing were parallel to the horizontal face of the slab edge.

7. Joint Packing Material (Additional Element):
12 inch long, 4 inch thick mineral wool of 4-pcf density (Thermafiber Safing) was centered at the mullion and installed with 25% compression and depth to overcome slab thickness (integrated mullion cover).

8. Fill, Void or Cavity Material (Outer Fire Retardant Coating):
A min. ⅛ inch wet film thickness of Hilti Firestop Joint Spray CFS-SP WB was sprayed over top of the joint packing material and overlapped the top surface concrete slab with a min. of ½ inch and the interior face of aluminum transom overlapping onto the aluminum members at least ½ inch.

9. Connecting Framing Element:
Galvanized steel metal sheet made from 18 gauge galvanized steel (4½ inch×6 inch) was positioned in front on the mullion and clamped between the underside of the slab and the artificial spandrel (second element) and fastened with Hilti Kwik HUS-EZ ¼ inch×1⅞ inch steel concrete anchors.

10. Mounting Attachment:
Attach aluminum framing to the structure framing according to the curtain wall manufacturer's instructions connect the mounting attachments to the joint face of the concrete floor assembly according to the curtain wall manufacturer's instructions.

Testing and Evaluation Method

Instrumentation:
Thirty-five (35) 24 GA, Type K, fiberglass jacketed thermocouples (TCs) were installed in compliance with the standard: 12 TCs measured the temperature up to the center of the exterior, 11 TCs measured the temperatures on the perimeter joint and the supporting frame, and 12 TCs measured furnace temperatures. The output of the thermocouples was monitored by a 100-channel Yokogawa, Inc., Darwin Data Acquisition Unit. The computer was programmed to scan and save data every 15 seconds.

Test Standard:
Testing was conducted in accordance with the applicable requirements, and following the standard method of ASTM E2307, Standard Test Method for Determining Fire Resistance of Perimeter Fire Barriers Using Intermediate-Scale, Multi-story Apparatus, 2015.

The assembly was secured to the test laboratory's Intermediate-Scale, Multi-story Test Apparatus (ISMA), with ceramic fiber insulation installed between the assembly and the furnace to create an effective seal. The window burner was centered on the vertical centerline of the window, 9 inch below the top of the opening, and with the longitudinal centerline pf the burner 3 inch from the plane of the exterior wall, consistent with the standard and the calibration of the test apparatus. The assembly was tested using commercial grade propane gas at the flow rates determined during calibration of the apparatus.

Testing and Evaluation Results

The ambient temperature at the time of the test was 73° F. and the humidity was 76% R.H. The test was conducted for 130 min. Transmission of heat through the fire barrier during the test did raise the average temperature on the unexposed surface more than 250° F. and raised the individual temperature more than 325° F. The average temperature limit was exceeded after 104 min. and the single point limit was exceeded after 45 min. The perimeter fire barrier did not allow the passage of flames throughout the duration of the test.

Based on the results of this test, the test assembly achieved, a T-Rating of 45 min. and an F-Rating of 120 min.

It has been shown, that the thermally insulating and sealing system of the present invention for sealing between the edge of a floor and an interior wall surface of a glass curtain wall construction maintains sealing of the safing slots surrounding the floor of each level in a building.

It has been demonstrated that the thermally insulating and sealing system for a glass curtain wall structure of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining safing insulation between the floors of a residential or commercial building and the exterior curtain wall responsive to various conditions including fire exposure is guaranteed.

Further, it has been shown, that the thermally insulating and sealing system of the present invention meets the requirements of a full-scale ASTM E 2307 tested system for floor assemblies where the vision glass extends to the finished floor level, addressing the code exception, avoiding letters and engineering judgments and securing and providing defined/tested architectural detail for this application, in particular providing a tested system for fire safe architectural compartmentation.

The tested system according to the present invention provides for integrated and unexposed mullion covers whose thickness ends at the bottom of the floor surface for maximum vision glass exposure. The tested system utilizes no aluminum or faced curtain wall insulation, and the safing insulation can be pre-installed from one side, which maintains the safing insulation between the floors of a residential or commercial building and the glass curtain wall responsive to various conditions, including fire exposure, and maximizes safing insulation at a minimal cost.

In particular, the tested system according to the present invention provides for the employment of reduced curtain wall insulation to only 6 inch height, resulting in up to 40% curtain wall material savings to the closest 10 inch spandrel system. Further, no top horizontal transom cover is needed for maximum vision glass/architectural exposure top of slab. Another great advantage of the thermally insulating and sealing system of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

It has been also shown that a building construction is provided comprising such a thermally insulating and sealing system for effectively thermally insulating and sealing of the safing slot between a glass curtain wall structure and the edge of a floor, in particular within the zero spandrel area, wherein the vision glass of a curtain wall structure extends to the finished floor level below, thereby creating a continuous fireproofing seal extending from the outermost edge of the floor to the curtain wall structure and, in particular, to abutment with the interior wall surface.

Further, the thermally insulating and sealing system is not limited to a specific joint width or spandrel height; installation on the face of the transom is possible.

As such, the thermally insulating and sealing system of the present invention provides a system for effectively maintaining a complete seal in a safing slot when utilizing a glass curtain wall construction, vision glass extends to the finished floor level below.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A thermally insulating and sealing system for effectively thermally insulating and sealing of a safing slot within a building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor, comprising:

i) a first element comprised of a thermally resistant material for insulating positioned in the safing slot, wherein the first element includes:
   a) an inner primary end surface positionable in abutment with respect to the outer edge of the floor for sealing thereadjacent;
   b) an outer primary end surface positionable spatially disposed from the interior wall surface of the curtain wall construction; and
   c) a lower primary facing surface extending between the inner primary end surface and the outer primary end surface and facing downwardly therebetween;

ii) a second element comprised of a non-combustible material for receiving the first element positioned substantially in the safing slot in abutment with respect to a bottom of the floor and essentially spatially disposed from the interior wall surface of the curtain wall construction, wherein the second element includes:
   a) a web section having opposing edges; and
   b) a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other; and iii) a supplemental element for attaching of the second element with respect to the bottom of the floor;

wherein the second element is attached using the supplemental element to the bottom of the floor and to an interior horizontal framing member of the curtain wall construction.

2. The thermally insulating and sealing system according to claim 1, wherein the second element is positioned spatially disposed from the interior wall surface of the curtain wall construction and spatially disposed from the lower primary facing surface of the first element, and extends across the safing slot toward the outer edge of the floor thereadjacent.

3. The thermally insulating and sealing system according to claim 1, wherein the second element is a metal material.

4. The thermally insulating and sealing system according to claim 3, wherein the metal material is steel.

5. The thermally insulating and sealing system according to claim 1, further comprising a third element comprised of a thermally resistant material for insulating positioned in the safing slot in abutment with respect to the outer primary end surface of the first element and in abutment to an interior of the web section of the second element and partially to inner facing surfaces of the outwardly extending sidewalls of the second element.

6. The thermally insulating and sealing system according to claim 5, wherein the first element and the third element each comprise a thermally resistant flexible material to facilitate placement thereof into the safing slot adjacent one another.

7. The thermally insulating and sealing system according to claim 5, wherein the first element and the third element each comprise a thermally resistant flexible mineral wool material to facilitate placement thereof into the safing slot adjacent one another.

8. The thermally insulating and sealing system according to claim 7, wherein the thermally resistant flexible mineral wool material is installed with fibers running parallel to the outer edge of the floor and the interior of the web section of the second element.

9. The thermally insulating and sealing system according to claim 1, further comprising a connecting framing element of a non-combustible material, positioned between the second element and the bottom of the floor in front of a vertical framing member.

10. The thermally insulating and sealing system according to claim 9, wherein the connecting framing element is a metal material.

11. The thermally insulating and sealing system according to claim 10, wherein the metal material is steel.

12. The thermally insulating and sealing system according to claim 1, further comprising an additional element comprised of a thermally resistant material for insulating positioned in the safing slot in abutment with respect to the lower primary facing surface of the first element and to an upper facing surface of one of the outwardly extending sidewalls of the second element.

13. The thermally insulating and sealing system according to claim 12, wherein the additional element comprises a thermally resistant flexible mineral wool material to facilitate placement thereof into the safing slot.

14. The thermally insulating and sealing system according to claim 1, wherein the supplemental element is a structural fastening element.

15. The thermally insulating and sealing system according to claim 14, wherein the structural fastening element is a pin, an expansion anchor, a screw anchor, a bolt, or an adhesion anchor.

16. The thermally insulating and sealing system according to claim 15, wherein the structural fastening element extends through the second element and is attached to the bottom of the floor and to the interior horizontal framing member of the curtain wall construction.

17. The thermally insulating and sealing system according to claim 1, further comprising an outer fire retardant coating positioned across the first element and adjacent portions of an interior framing member of the curtain wall construction and the floor located thereadjacent.

18. The thermally insulating and sealing system according to claim 17, wherein the outer fire retardant coating has a wet film thickness of at least ⅛ inch.

19. The thermally insulating and sealing system according to claim 17, wherein the outer fire retardant coating covers a top of a thermally resistant flexible mineral wool material overlapping the outer edge of the floor and an interior face of the interior framing member of the curtain wall construction by a min. of ½ inch.

20. The thermally insulating and sealing system according to claim 18, wherein the outer fire retardant coating is a water-based or silicone-based outer fire retardant coating.

21. The thermally insulating and sealing system according to claim 20, wherein the outer fire retardant coating is in a form of an emulsion, a spray, a coating, a foam, a paint or a mastic.

22. A building construction having a curtain wall construction defined by an interior wall surface including one or more framing members and at least one floor spatially disposed from the interior wall surface of the curtain wall construction defining a safing slot extending between the interior wall surface of the curtain wall construction and an outer edge of the floor, comprising:

a thermally insulating and sealing system for effectively thermally insulating and sealing of the safing slot, comprising:

a first element comprised of a thermally resistant material for insulating positioned in the safing slot, wherein the first element includes:

an inner primary end surface positionable in abutment with respect to the outer edge of the floor for sealing thereadjacent;

an outer primary end surface positionable spatially disposed from the interior wall surface of the curtain wall construction; and a lower primary facing surface extending between the inner primary end surface and the outer primary end surface and facing downwardly therebetween;

a second element comprised of a non-combustible material for receiving the first element positioned substantially in the safing slot in abutment with respect to a bottom of the floor and essentially spatially disposed from the interior wall surface of the curtain wall construction, wherein the second element includes:

a web section having opposing edges; and a pair of outwardly extending sidewalls integrally connected to the web section, wherein each sidewall has a proximal end and a distal end, wherein the proximal end of each sidewall is integrally connected to one of the opposing edges of the web section, and wherein the sidewalls are substantially parallel and confront each other;

wherein the second element is positioned spatially disposed from the interior wall surface of the curtain wall construction and spatially disposed from the lower primary facing surface of the first element, and extends across the safing slot toward the outer edge of the floor thereadjacent;

a supplemental element for attaching of the second element with respect to the bottom of the floor, wherein the second element is attached using the supplemental element to the bottom of the floor and to an interior horizontal framing member of the curtain wall construction;

a third element comprised of a thermally resistant material for insulating positioned in the safing slot in abutment with respect to the outer primary end surface of the first element and in abutment to an interior of the web section of the second element and partially to inner facing surfaces of the outwardly extending sidewalls of the second element;

a connecting framing element of a non-combustible material, positioned between the second element and the bottom of the floor in front of a vertical framing member;

an additional element comprised of a thermally resistant material for insulating positioned in the safing slot in abutment with respect to the lower primary facing surface of the first element and to an upper facing surface of one of the outwardly extending sidewalls of the second element; and an outer fire retardant coating positioned across the first element and adjacent portions of an interior framing member of the curtain wall construction and the floor located thereadjacent.

23. The building construction according to claim 22, wherein the curtain wall construction includes a vision glass infill and one or more metal framing members.

24. The thermally insulating and sealing system according to claim 1 wherein the second element further includes one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls.

25. The building construction according to claim 22 wherein the second element further includes one laterally extending ledge section integrally connected to one of the pair of outwardly extending sidewalls, wherein the ledge section has an inner edge and an outer edge, and wherein the inner edge of the ledge section is integrally connected to the distal end of one of the pair of sidewalls.

* * * * *